United States Patent [19]

Seibert

[11] 4,132,369

[45] Jan. 2, 1979

[54] COMPENSATING STORAGE FOR CABLE OR THE LIKE

[76] Inventor: Gerhard Seibert, Butzendopplergasse 3, 1232 Vienna, Austria

[21] Appl. No.: 892,189

[22] Filed: Mar. 31, 1978

[30] Foreign Application Priority Data

Apr. 2, 1977 [DE] Fed. Rep. of Germany ..... 2714839

[51] Int. Cl.[2] ..... B65H 75/34

[52] U.S. Cl. ..... 242/47.5

[58] Field of Search ..... 242/47.5; 137/355.16, 137/355.17, 355.2, 355.23; 191/12 R

[56] References Cited

U.S. PATENT DOCUMENTS

| | | | |
|---|---|---|---|
| 2,201,954 | 5/1940 | Flygare | 242/47.5 UX |
| 2,896,659 | 7/1959 | Erickson | 242/47.5 X |
| 3,403,866 | 10/1968 | Bell et al. | 242/47.5 |

FOREIGN PATENT DOCUMENTS

| | | | |
|---|---|---|---|
| 393188 | 12/1973 | U.S.S.R. | 242/47.5 |

*Primary Examiner*—Stanley N. Gilreath
*Attorney, Agent, or Firm*—Martin A. Farber

[57] ABSTRACT

A compensating storage for cable or the like comprising a group of rollers fixed on a frame and a group of compensating rollers moveable on horizontal rails, the compensating rollers being loaded by a storage tensioning device, whereby the cable is wound around both groups of rollers as a pulley rope. Support rollers for the upper cable strands are arranged between both groups of rollers, the support rollers being moveable on horizontal rails. The support rollers on the one hand lie in the path of movement of the inwardly moving compensating rollers and are able to be pushed together by the latter, and on the other hand are able to be drawn apart from one another by towing members which are connected to the compensating rollers.

7 Claims, 3 Drawing Figures

COMPENSATING STORAGE FOR CABLE OR THE LIKE

Figure 1:
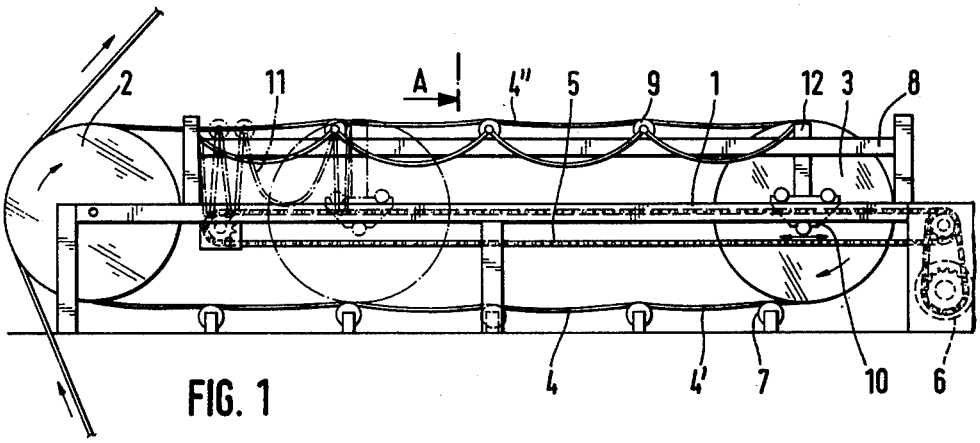

The invention relates to a compensating storage for cable or the like which comprises a group of rollers or pulleys fixed on a frame and a group of compensating rollers moveable on horizontal rails, the compensating rollers being loaded by a storage tensioning device, whereby the cable or the like is wound around the rollers of both groups according to the type of a pulley rope.

Such types of compensating rollers are particularly used inside of systems for continuous manufacturing of cable and serve for storing of the cables during an exchange on the winding-up drums. Horizontal roller storages can be equipped with relatively large rollers, e.g. 800 to 2000 mm diameter and are thus suited for the storage of heavy cables and ropes. Compensating storages are built with stroke lengths of approximately 5 to 20 m, so that there result large saggings for the individual cable strands. With thick, heavy cables, as a consequence of this, high tensile forces must be applied for tensioning of the strands, which requires the use of comparatively large dimensioned storage tensioning devices. Moreover with the known arrangements the long cable strands tend to swing, which again is unfavorable to the entire cable production system.

The invention is based on the task thus to improve a horizontal compensating storage of the generic type, such that only yet smaller tensile forces are to be applied for stretching the cable strands and that the cable strands remove the possibility for oscillations. For solution of this task in accordance with the invention, it is provided that the compensating storage is equipped with support rollers for the upper cable strands, the support rollers being arranged between the two groups of rollers, the support rollers being moveable on horizontal rails, and that the support rollers on the one hand lie in the path of movement of the inwardly moving compensating rollers and are able to be pushed together by these and on the other hand are able to be drawn apart from one another by towing members which are connected to the compensating rollers. By means of these support rollers, the weight of the strands of the upper cable are picked-up or received, so that only comparatively small tensile forces must still be applied for stretching of the strands. At the same time larger saggings are avoided and the danger of an oscillation of the cable strands is avoided.

The dependent claims result in advantageous formations of the invention.

Figure 2:
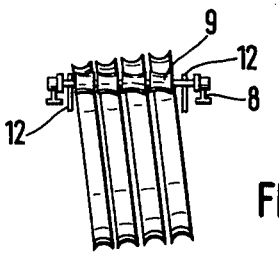
Figure 3:
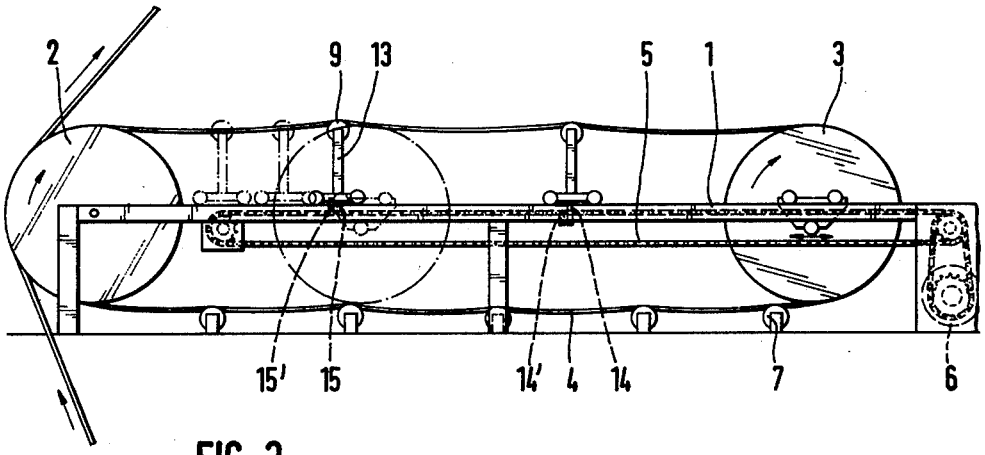

In the following, the invention is more closely described on the basis of two embodiment examples illustrated in the drawing. In the drawing it shows:

FIG. 1 is a first embodiment of the compensating storage according to the invention in side view, FIG. 2 is a partial view seen in the direction of the arrow A in FIG. 1 and FIG. 3 is a second embodiment of the compensating storage according to the invention in side view.

The machine frame is formed by horizontal rails 1 with corresponding supports. On one end of this frame there are disposed fixed rollers 2, whereas compensating rollers 3 are able to move back and forth on the rails 1 (only the front being illustrated). The passing continuous rope or cable 4 winds around the fixed and moveable pulleys 2, 3 with the passage therethrough. For tensioning the moveable compensating rollers 3, a revolving chain 5 is used, which is driven by a motor 6. For example, it deals with a direct current motor, which by corresponding control, loads the compensating rollers 3 with an adjustable, constant pulling force.

For unloading or lightening the storage tensioning device which comprises the chain 5 and the motor 6, under the lower cable strands 4', support rollers 7 are fixedly arranged, which lie underneath the path of movement of the compensating rollers 3 and thus do not hinder its movement. For the upper cable strands moreover, moveable support rollers 9 are provided on separate rails 8, which rails 8 lie above the compensating roller rails 1, the support rollers 9 being connected with one another and with the car 10 of the compensating rollers 3, respectively, by towing members in the form of ropes or chains 11. With a tension or loading of the compensating storage, consequently the upper support rollers 9 are successively pulled apart from one another so that they support the upper cable strands 4'' at uniform distances. On the car 10 of the compensating rollers 3 there are provided upwardly directed studs 12, which studs 12 with an inward movement of the compensating rollers 3 strike on the upper support rollers 9, and their common axle, respectively, and push these together.

The support rollers 9 and 7, respectively, are formed such that there is coordinated to each cable strand a particular, advantageous V-shaped grooved single roller, since with movement of the compensating rollers 3, the individual cable strands have different speeds.

With the embodiment of FIG. 3 the upper support rollers 9 each are mounted on cars 13 which are moveable on the compensating roller rails 1. On the cars 13 to the side of the compensating rollers 3 there are mounted respectively deeper, downwardly extending driver studs 14, 15, whereas the chain 5 is provided with counter studs 14' and 15' respectively lying higher at the side of the rigid rollers 2, such that with an outward movement of the compensating rollers 3, the support rollers 9 and respectively their cars 13 are successively pulled apart from one another. Instead of the drivers 14, 14' and 15, 15' with the embodiment according to FIG. 3 also cables or chains can be provided as towing members arranged in a garland-like manner between the cars 13 of the various upper support rollers 9.

I claim:

1. A compensating storage for cable or the like adapted to be wound around groups of fixed rollers and moveable compensating rollers as a pulley rope, comprising a frame including at least one set of horizontal rails, a plurality of first rollers fixed on said frame, a plurality of compensating rollers moveably mounted on said at least one set of horizontal rails, storage tensioning means for loading said compensating rollers, support rollers adapted to support upper strands of the cable, said support rollers being arranged between said plurality of first rollers and said plurality of compensating rollers, said support rollers being moveably mounted on said at least one set of horizontal rails, said support rollers being disposed in a path of inward movement of said compensating rollers, and thereby being pushed together by the latter, and means comprising towing members operatively connected to said compensating rollers for pulling said support rollers apart from one another.

2. The compensating roller according to claim 1, wherein said at least one set of horizontal rails includes first horizontal rails and second horizontal rails, the latter are separated and spaced apart from said first horizontal rails, said support rollers are mounted on said second horizontal rails, the latter constituting running rails and arranged above said first horizontal rails, car means for moveably mounting said compensating rollers on said first horizontal rails, respectively, said car means include driver stud means projecting upwardly therefrom for operatively engaging said support rollers.

3. The compensating roller according to the claim 1, wherein said towing members comprise ropes, said ropes connect said support rollers with one another and with said car means of said compensating rollers.

4. The compensating roller according to the claim 1, wherein said towing members comprise chains, said chains connect said support rollers with one another and with said car means of said compensating rollers.

5. The compensating storage according to claim 1, further comprising cars moveably mounted on said at least one set of horizontal rails, the latter constituting a single set of horizontal rails, said support rollers each are mounted on one of said cars.

6. The compensating storage according to claim 5, wherein said storage tensioning means comprises a motor driven, revolving chain, said towing members comprise:

said chain, and driver studs mounted on said cars and on said chain, respectively, and abuttingly cooperating pairwise with one another.

7. The compensating storage according claim 1, further comprising lower support rollers mounted fixedly on the machine and adapted to support lower cable strands of the cable, said lower support rollers being arranged underneath the path of movement of said compensating rollers.

* * * * *